US005362201A

United States Patent [19]

Uhrner et al.

[11] Patent Number: 5,362,201

[45] Date of Patent: Nov. 8, 1994

[54] WATER PUMP LUBRICATING CHAMBER ARRANGEMENT FOR MOTOR VEHICLES

[75] Inventors: Klaus-Jürgen Uhrner, Leingarten/BR; Eugen Schlötzer, Rednitzhembach/BR, both of Germany

[73] Assignee: Kaco GmbH & Co., Heilbronn, Germany

[21] Appl. No.: 90,513

[22] Filed: Jul. 12, 1993

[30] Foreign Application Priority Data

Jul. 17, 1992 [DE] Germany ..... 4223544

[51] Int. Cl.[5] ..... F01D 25/22; F04D 29/06

[52] U.S. Cl. ..... 415/111; 415/110; 384/462

[58] Field of Search ..... 415/110, 111; 384/462, 384/477, 504

[56] References Cited

U.S. PATENT DOCUMENTS

| | | | |
|---|---|---|---|
| 1,704,362 | 3/1929 | Johnson | 415/111 |
| 2,694,981 | 11/1954 | Daugherty et al. | 415/110 |
| 4,439,096 | 3/1984 | Rockwood et al. | 415/131 |
| 4,936,742 | 6/1990 | Eguchi et al. | 415/111 |
| 5,261,676 | 11/1993 | Rockwood | 277/42 |

FOREIGN PATENT DOCUMENTS

| | | | |
|---|---|---|---|
| WO91/12412 | 8/1991 | WIPO | 415/110 |

*Primary Examiner*—Edward K. Look
*Assistant Examiner*—Michael S. Lee
*Attorney, Agent, or Firm*—Albert H. Reuther

[57] ABSTRACT

A motor vehicle water pump lubricating chamber arrangement having a housing in which a pump shaft is rotatably journalled which carries a running wheel at a free end thereof and which in a lower region adjoining the running wheel has at least one seal. In a region above the lower seal between the pump shaft and the housing there is provided a chamber filled with lubricating medium so that any fluid lubricant which can otherwise discharge around the shaft will have such fluid caught in the lubricating medium chamber rather than escaping with any trace and track of escaping fluid along any external surface of the water pump which could mislead someone to prematurely replacing the water pump when such replacement is not yet necessary. The pump shaft is journalled free of play via roller bearings including roller bodies pressed into the raceways provided on the pump shaft and on the housing respectively.

2 Claims, 1 Drawing Sheet

WATER PUMP LUBRICATING CHAMBER ARRANGEMENT FOR MOTOR VEHICLES

BACKGROUND OF THE INVENTION

1. Field of the Invention

The present invention pertains to a pump, especially a water pump for motor vehicles, with a housing, in which a pump shaft is rotatably journalled, which at a free end carries a running wheel or caster and which in a lower region adjacent to the running wheel has at least one seal.

2. Description of the Prior Art

With such pumps in the housing wall there are provided bores through which, during the operation, fluid or liquid rising upwardly via the lower seal discharges. The leakage fluid hereby causes visible tracks or traces along the housing wall. Such tracks or traces induce or cause a user to exchange the pump even though functionally an exchange would not be necessary.

SUMMARY OF THE INVENTION

An object of the present invention basically is to embody and construct the generic pump in such a manner that a premature exchange of the pump also upon encountering leakage that may occur will no longer cause an exchange to be carried out.

This object is fulfilled with the generic pump in accordance with the present invention such that in a region above the lower seal between the pump shaft and the housing there is provided a space or chamber filled with lubricating medium.

With the present inventive pump there is noted that upon encountering an eventual leakage that the leakage fluid rises between the pump shaft and the lower seal upwardly and comes there into the space or chamber filled with lubricating medium. In this location the leakage fluid is caught-up, intercepted or absorbed in the lubricating medium. Discharge bores for the leakage fluid consequently are no longer required with the present inventive pump. Moreover, when leakage occurs, no visible tracks or traces can be seen along the housing outer side. Thereby there is prevented and precluded that the pump is prematurely exchanged accordingly when the pump is still functionally completely capable of functioning.

Further objects and advantages of the present invention are apparent from the following description and disclosure, reference being made to the drawing setting forth features of the present invention in greater detail.

BRIEF DESCRIPTION OF THE DRAWING

The FIG. 1 of the drawing in an axial section shows the present inventive pump, which is secured and fastened on a partially illustrated motor block.

DETAILED DESCRIPTION

Figure 1:
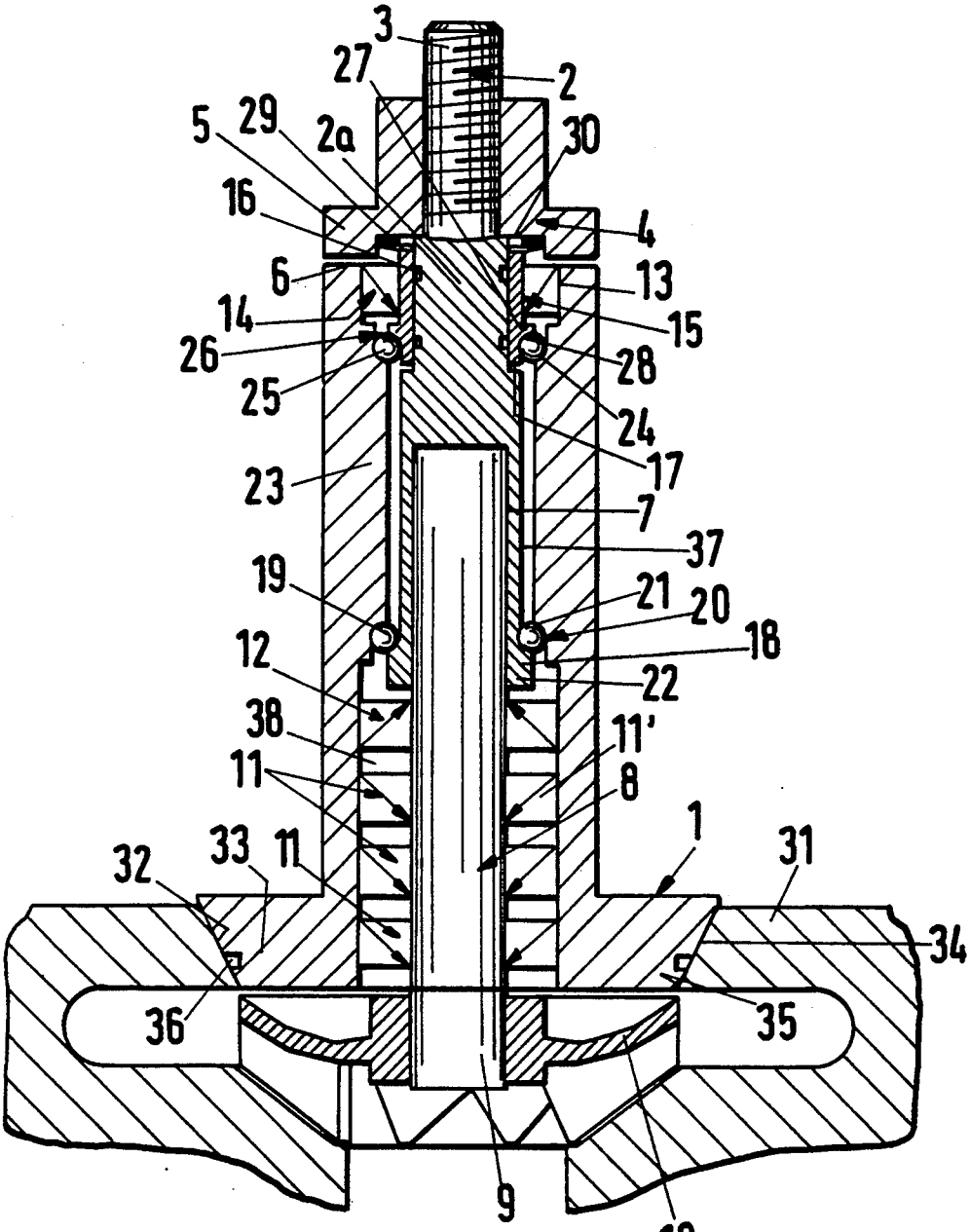

The pump is preferably a water pump which is installed in a motor vehicle. The pump has a bearing housing 1, which preferably has a circular cross section and in which a pump shaft 2 is rotatably journalled. Upon an end 3 of a shaft part 2*a* of the pump shaft 2 projecting axially over the bearing housing 1 there is seated rotatably secured or fixed a drive part 4, which in the illustrated sample embodiment is a flange for securing a belt pulley over which a drive belt is guided and conveyed. The drive part 4 at an end toward the bearing housing 1 has a radially projecting flange 5, which with a small or nominal spacing lies opposite to the face or end side 6 of the bearing housing 1. The outer diameter of the flange 5 corresponds to the outer diameter of the bearing housing 1.

Inside the bearing housing 1, the shaft part 2*a* is provided with a central depression, cavity or recess 7, into which a shaft part 8 is installed, of which an end 9 projecting from the bearing housing 1 carries a running wheel 10 fixed or rotationally secured. The shaft part 8 consists of ceramic material and is surrounded by the bearing housing 1 with a radial spacing relative thereto. The shaft part 2*a* consisting of metallic material is shrunk upon the shaft part 8, so that a satisfactorily fixed and secure connection is produced between the two shaft parts. In a region below the shaft part 2*a*, the bearing housing 1 is expanded or widened in the inner diameter thereof, so that in this region there is created a receiving space or chamber 37 for the seals 11 and 12. In the illustrated sample embodiment in this receiving chamber between the running wheel 10 and the end of the shaft part 2*a* toward or directed relative thereto, four seals are installed and accommodated of which the seal 12 seals-off against oil or lubricant, while the three seals 11 located there below prevent the entry of water, contaminants or dirt particles and the like contained therein. The seals 11, 12 are pressed into the bearing housing 1 in a known manner and lie sealingly against the shaft part 8. Preferably the seals 11 and 12 are radial shaft seal rings, which engage with at least one sealing edge of a sealing lip against the shaft part 8. In place of such radial shaft seal rings there also can be installed slide rings seals.

Departing from the illustrated sample embodiment it is adequate when only one seal 11 is provided which prevents the entry of water and contaminants, dirt particles and abrasive particles contained therein.

Since the shaft part 8 consists of ceramic material, the shaft part 8 has a very long service life or duration of life because the ceramic material is extremely wear resistent. Consequently, during installation of the pump, no running tracks or traces occur or arise in the shaft part 8, which with other materials would be produced or generated by the seals. During the service life of the pump there is assured thereby a satisfactory sealing-off on the shaft part 8. Thereby there is reliably prevented that the medium to be pumped rises up along the shaft 2 as far as to the bearings 20, 26 located behind the seal 11, 12. With that there is avoided that, for example, any abrasive particles located in the medium to be pumped reach the bearings 20, 26, even when the pump is already installed for a longer period of time.

The bearing housing 1 at the end remote or away from the running wheel 10 is widened or expanded along an inner side or internally thereof to form a receiving space or chamber 13 for a further seal 14. The seal 14 is pressed into the receiving chamber 13 and lies sealingly against a tensioning sleeve or case 15 which is seated rotatably fixed upon the shaft part 2*a*. The tensioning sleeve 15 is sealed-off with respect to the shaft part 2*a* by two seal rings 16 and 17, which are installed and accommodated in annular or ring grooves in the mantle surface of the shaft part 2*a*.

The shaft part 2*a* near an end thereof toward the seals 11 and 12 has a running path or raceway 18 provided for roller bodies 19 of a roller bearing 20. The rollers or roller bodies 19 are preferably spheres or balls, which run in the raceway 18 of the shaft part 2*a* and in a raceway 21 of the bearing housing 1. The shaft part 2a at an end 22 thereof toward the running wheel 10 is constructed thickened or enlarged for formation of the raceway 18. The forces exerted via the roller bodies 19 during installation and employment of the pump can thereby be taken up reliably by the shaft part 2a.

The raceway 21 in the inner wall of the bearing housing 1 at a transition from the receiving chamber for the seals 11, 12 to the shaft part 2a is provided with spacing as to the surrounding bearing housing part. The raceway 21 thereby likewise is located in a thickened wall region of the bearing housing 1, so that the load or burdens which are brought about and caused by the roller bearing 20 in the installation and employment of the pump also are taken up safely and securely by the bearing housing. The thickened bearing housing part 21 is provided at a transition to the receiving chamber 13 for the seal 14 with a further raceway 24 for the roller bodies 25, preferably spheres or balls, of a further roller bearing 26. The tensioning sleeve or case 15 is near its end toward the drive part 4 provided with a radially outwardly directed flange 27, the underside of which remote or away from the drive part 4 is embodied or constructed as a raceway 28 for the roller bodies 25. The roller bearing 26 is located with small or nominal spacing below the seal 14.

The roller bodies 19, 25 of the two roller bearings 20, 26 are pressed into the pertaining raceways so that an absolute freedom from play of the roller bodies 19, 25 is assured and guaranteed. This has as a consequence that the roller bodies 19, 25 and/or the pertaining raceways 18, 21, 24, 28 are subject to substantially no wear. Especially there is prevented and hindered thereby that the roller bodies 19, 25 become worn and are caused to be out-of-round (that is to avoid encountering of untrue-running or eccentricity).

The tensioning sleeve 15 stands under a force of at least one pressure spring 29, which preferably is formed by at least one plate or disc spring. It is also possible to provide a plate or disc spring package. The pressure spring 29 lies in a face-side or end depression or recess 30 of the drive part 4 and lies or engages upon the tensioning sleeve 15. Via the pressure spring 29, the tensioning sleeve 15 with its flange 27 is pressed rigidly against the roller bodies 25, which thereby are pressed play-free into the raceway 24 of the bearing housing 1. During screwing-on of the drive part 4 upon the shaft end 3, the pump shaft 2 is pulled or drawn upwardly in the drawing via the pressure spring 25, whereby the thickened end region 22 of the shaft part 2a presses the roller bodies 19 securely into the raceways 18, 21.

The intermediate connection of the pressure spring 29 between the drive part 4 and the tensioning sleeve 15 has the advantage that the length variations of the tensioning sleeve and/or of the bearing housing 1 as a consequence of heat expansions can be caught or taken up, so that the roller bodies 19, 25 cannot be overloaded. Upon occurrence of such heat expansions the tensioning sleeve 15 can shift against the force of the pressure spring 29 relative to the shaft part 2a and with that also can shift with respect to the bearing housing 1.

If such heat expansions are not to be feared, the tensioning sleeve 15 also can be constructed unitary or integrally with the shaft part 2a. In this case, the force for pressing against or into engagement for play-free guidance and journalling of the roller bodies 19, 25 are attained by screwing-on or pressing-on the drive part 4 upon the shaft end 3.

The pump is added or installed with its bearing housing 1 on a motor block 31, which is provided with an opening 32 for adding-on the pump. The diameter thereof is so large that the running wheel 10 can be inserted through the add-on opening 32 and passing therethrough to the motor block 31. In the build-in position of the pump accordingly the running wheel 10 is located inside the motor block 31.

The bearing housing 1 at an end toward the running wheel side has a radially outwardly directed flange 33 with which the pump is installed in the add-on opening 32. The flange 33 has a conical surface 34 as a mantle surface. In the same manner, the add-on respectively build-in opening 32 has a conically shaped edge 35. The two conical surfaces 34 and 35 have the same conical angle, which preferably is greater than the angle of self restraint. Thereby the pump in a required situation can be removed or taken off simply from the motor block 31. The conical surfaces 34, 35 have the advantage that the installation or build-in opening 32 and the conical surface 34 need not be produced with close tolerances and that moreover a secure seat of the flange 33 is assured and guaranteed in the motor block 31. In the conical surface 34 and/or in the conical-shaped edge 35 of the installation or build-in opening 32 there is journalled a seal ring 36, so that the installation or build-in opening is satisfactorily sealed-off.

In the installation or built-in position, the pump then is connected rigidly with the motor block 31 in a suitable manner.

The motor block 31 also can provide a cylindrical installation or a build-in opening in place of the preferred conical seat arrangement. Then however a very accurate fitting is required in order to assure and guarantee a satisfactory seating or fitting of the pump in the installation or build-in opening 32. Additionally, a removal tool or a removal device is required for removal of the pump from the motor block 31 and such removal tool or removal device would not be necessary with the preferred embodiment with conical seat arrangement. There the pump can be removed without such tools or devices in the required situation for removal from the motor block 31.

Finally, it is also possible to provide the installation or build-in opening 32 with an inner thread, so that the bearing housing 1 can be screwed into this installation or build-in opening 32. In this situation, the threads must be sealed-off in a suitable manner.

The two shaft parts 2a and 8 also can be constructed integrally or unitary with each other and then can consist continuously of ceramic material in the entirety thereof. In this situation, the shrink-fit procedure for connection of the two shaft parts is not necessary.

With another (non-illustrated) embodiment, the two shaft parts 2a and 8 as well as the running wheel 10 can be produced integrally or unitarily with each other of ceramic material entirely. In this situation the running wheel 10 need not be installed upon the shaft part 8 in any additional working step or procedure.

The pump can be produced in a cost-advantageous manner and has a long service life. Since the shaft part 8 consists of ceramic material, the shaft part 8 is very wear resistant, so that the seals 11 and 12 engaging thereagainst do not lead to a premature wear of the shaft part 8 and with that leading to an early and premature failure of the pump. Since the roller bodies 19, 25 are pressed into the raceways 18, 21, 24, 28, the roller bearings 20, 26 have no play, so that they likewise are subject to only a very small or nominal wear during employment of the pump in actual use. Eventually the pump can be removed extremely simply from the motor block 31. Then, for example, the seals can be comfortably and readily interchanged when such seals possibly or eventually are damaged.

Above the lower seal 12 sealed-off against oil or also above the uppermost seal 11' of the lower seal 11 sealed-off against water there is provided an annular or ring chamber 37 between the bearing housing part 23 and the pump shaft 2. This annular chamber 37 is constructed as a lubricating medium space or chamber which is filled with a lubricating medium. Preferably the lubricating medium space or chamber 37 extends as far as to the receiving chamber 13. The bearings 20, 26 which are located in this space or chamber are lubricated with the lubricating medium. Upwardly the lubricating medium space or chamber 37 is sealed-off by the upper seal 14. If during the operation of the pump 2 leakage fluid rises between the pump shaft and the lower seal 12 upwardly, then the fluid comes into the lubricating medium and is caught, intercepted or absorbed therein. The bores provided with known pumps in the housing walls thereof are not needed or provided in accordance with the present invention. Consequently also no leakage fluid reaches the outside. Consequently no traces or tracks of discharging leakage fluid arise or occur along the housing outer wall. The pump for this reason also is not exchanged too early or prematurely. Consequently considerable costs can be saved. The seals 12 and 14 for example can be made as slide-ring seals.

In conclusion, the present invention provides a pump, especially a water pump, for motor vehicles, with a housing in which a pump shaft is rotatably journalled, which carries a running wheel at a free end thereof and which has at least one seal in a lower region adjoining the running wheel. The characterizing feature of the present invention is that in the region above the lower seal 12 between the pump shaft 2 and the housing 1 there is provided a space or chamber 37 filled with lubricating medium.

The lubricating medium chamber 37 extends from the lower seal 12 as far as to the upper seal 14 and the bearings 20, 26 for the pump shaft 2 are located in the lubricating medium chamber 37.

The present invention also provides a pump of which the pump shaft is rotatably supported with roller bearings, particularly according to the foregoing, includes having the roller bodies 19, 25 of the roller bearing 20, 26 pressed free of play into the raceways 18, 21, 24, 28 thereof.

The raceways 18, 21; 24, 28 are provided on the pump shaft 2 and on the housing 1.

The pump shaft 2 has a thickened end region 22 on which one of the raceways 18 is provided.

On the pump shaft 2 there is seated a tensioning sleeve 15 which provides one of the raceways 28.

The tensioning sleeve 15 has a radially projecting flange 27 on which one raceway 28 is provided.

The pump housing 1 has a thickened wall segment 23 at the two ends of which respectively one of the raceways 21, 24 is provided.

The raceways 21, 24 on the housing side have a smaller axial spacing from each other than the raceways 18, 28 on the pump side.

The tensioning sleeve 15 is seated axially shiftable upon the pump shaft 2.

The tensioning sleeve 15 is axially shiftable against a counterforce.

The tensioning sleeve 15 is shiftable against the force of at least one pressure spring, particularly a disc spring.

The pressure spring 29 is supported on a drive part 4 seated fixed against rotation upon the pump shaft 2.

The drive part 4 provides a depression or recess 30 in which the pressure spring 29 is located.

The present invention provides a pump, particularly a water pump, for motor vehicles, with a housing, in which a pump shaft is rotatably journalled, which at a free end carries a running wheel and being sealed-off relative to the housing with at least one seal and the pump shaft at least in the region of the seal 11, 12 consists of ceramic material.

The pump shaft 2 consists of two shaft parts **2*a*, 8, of which the one shaft part 8** consists of ceramic material.

The other shaft part **2*a* is shrunk upon the shaft part 8** consisting of ceramic material.

The pump shaft 2 consists entirely of ceramic material.

The pump shaft 2 and the running wheel 10 are integral and unitary consisting of ceramic material.

The shaft part 8 consisting of ceramic material and the running wheel 10 are constructed unitary and integrally of ceramic material.

The seals 11, 12, 14 are radial shaft seals.

The seals 11, 12, 14 are slide ring seals.

The present invention is, of course, in no way restricted to the specific disclosure of the specification and drawing, but encompasses any modifications within the scope of the appended claims.

What we claim is:

1. A water pump having a lubricating chamber arrangement for motor vehicles, with a housing, in which a pump shaft is rotatably journalled, which carries a running wheel at a free end thereof and which in a lower region adjoining the running wheel has at least one seal means, comprising:

means forming an annular chamber filled with a lubricating medium provided in a region above a lower seal between the pump shaft and the housing;

said lower seal engages sealingly against the pump shaft and axially limits pump chamber means in which the running wheel is accommodated as installed therewith, the pump chamber means being sealed off by said at least one seal means relative to said annular chamber for receiving leakage fluid therein, said pump shaft extending through said annular chamber which at an end thereof remote from the running wheel is limited by an upper seal as well as having said annular chamber for receiving leakage fluid which mixes with lubricating medium already in said annular chamber extending continuously from said lower seal to said upper seal; and bearing means that rotatably support said pump shaft in said annular chamber for receiving the leakage fluid therein with said lubricating medium that lubricates said bearing means.

2. Pump means according to claim 1, in which said lubricating medium chamber means extends from the lower seal as far as to an upper seal, and that bearing means for the pump shaft are located in the lubricating medium chamber means.

* * * * *